US006458175B1

(12) United States Patent
Lehmann et al.

(10) Patent No.: US 6,458,175 B1
(45) Date of Patent: Oct. 1, 2002

(54) OIL ADDITIVES AND COMPOSITIONS

(75) Inventors: Edwin William Lehmann; Robert Dryden Tack, both of Oxfordshire (GB)

(73) Assignee: Exxon Chemical Patents Inc.

( * ) Notice: Subject to any disclaimer, the term of this patent is extended or adjusted under 35 U.S.C. 154(b) by 0 days.

(21) Appl. No.: 09/203,693

(22) Filed: Dec. 2, 1998

(30) Foreign Application Priority Data

Dec. 3, 1997 (GB) ..... 9725578

(51) Int. Cl.[7] ..... C10L 1/16; C10L 1/18

(52) U.S. Cl. ..... 44/398; 44/393; 44/394; 44/459; 508/450; 508/451; 508/496; 508/497; 508/475

(58) Field of Search ..... 44/398

(56) References Cited

U.S. PATENT DOCUMENTS

| | | | | | |
|---|---|---|---|---|---|
| 3,445,205 | A | | 5/1969 | Patinkin et al. | 44/397 |
| 3,847,561 | A | | 11/1974 | Feldman | 44/406 |
| 3,955,940 | A | | 5/1976 | Hollyday, Jr. | 44/394 |
| 3,961,916 | A | | 6/1976 | Iinyckyj et al. | 44/395 |
| 4,147,520 | A | | 4/1979 | Iinyckyj | 44/334 |
| 4,210,424 | A | * | 7/1980 | Feldman et al. | 44/394 |
| 4,211,534 | A | | 7/1980 | Feldman | 44/394 |
| 4,261,703 | A | * | 4/1981 | Tack et al. | 44/369 |
| 4,375,973 | A | * | 3/1983 | Rossi et al. | 44/394 |
| 4,464,182 | A | * | 8/1984 | Tack et al. | 44/393 |
| 4,631,071 | A | | 12/1986 | Axelrod et al. | 44/332 |
| 4,639,256 | A | | 1/1987 | Axelrod et al. | 44/391 |

FOREIGN PATENT DOCUMENTS

| | | |
|---|---|---|
| DE | 1959626 | 7/1970 |
| EP | 0 153 176 | 8/1985 |
| EP | 0 153 177 | 8/1985 |
| EP | 187 488 A1 | 7/1986 |
| EP | 0 225688 | 6/1987 |
| EP | 0 239320 | 9/1987 |
| EP | 255 345 A1 | 2/1988 |
| EP | 308 176 A1 | 3/1989 |
| EP | 0 403097 | 12/1990 |
| FR | 2143791 | 2/1973 |
| GB | 0 121 807 | 1/1984 |
| WO | WO 91/16407 | 10/1991 |
| WO | WO 94/00515 | 1/1994 |
| WO | WO 94/00536 | 1/1994 |
| WO | WO 98/03614 | 1/1998 |

OTHER PUBLICATIONS

N. A. Plate and V P Shibaev, "Comb Like Polymers. Structure and Properties" J. Poly. Sci. Macromolecular Revs. 8, p. 117 to 253 (1974).

"Journal of the Institute of Petroleum" vol. 52 (Jun. 1966), pp. 173–189.

* cited by examiner

*Primary Examiner*—Ellen M. McAvoy

(57) ABSTRACT

Compositions comprising a wax, a nucleator, and a wax growth arrestor improve the low temperature properties of fuel oils, especially high wax content fuels.

33 Claims, No Drawings

OIL ADDITIVES AND COMPOSITIONS

This invention relates to oil compositions, primarily to fuel oil compositions, and more especially to fuel oil compositions susceptible to wax formation at low temperatures, and to additive compositions for such fuel oil compositions.

Heating oils and other distillate petroleum fuels, for example, diesel fuels, contain alkanes that at low temperature tend to precipitate as large crystals of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter; certain additives inhibit the wax from crystallizing as platelets and cause it to adopt an acicular habit, the resulting needles being more likely to pass through a filter than are platelets. The additives may also have the effect of retaining in suspension in the fuel the crystals that have formed, the resulting reduced settling also assisting in prevention of blockages.

Effective wax crystal modification (as measured by CFPP and other operability tests, as well as simulated and field performance) may be achieved by ethylene-vinyl acetate or propionate copolymer (EVAC or EVPC)-based flow improvers.

In U.S. Pat. No. 3,961,916, middle distillate flow improvers are described which comprise a wax growth arrestor and a nucleating agent, the former being preferably a lower molecular weight ethylene-vinyl ester copolymer with a higher ester content, the latter preferably a higher molecular weight copolymer with a lower ester content, the esters preferably, but not necessarily, both being vinyl acetate.

In WO 94/00515, middle distillate flow improvers are disclosed which contain a mixture of two different ethylene-vinyl ester copolymers, or a single ethylene copolymer with two different vinyl esters, as nucleator optionally in admixture with an ethylene-vinyl ester copolymer arrestor, and a comb polymer, and other cold flow additives.

Similarly WO 94/00536 describes flow improvers containing a mixture of two different ethylene-vinyl ester copolymers, or a single ethylene copolymer with two different vinyl esters, as arrestor in admixture with an ethylene-vinyl ester copolymer nucleator and other cold flow additives.

Although ethylene unsaturated copolymers are very effective flow improvers in many middle distillate fuels, they are of limited utility in fuels of high wax content, i.e., with a wax content of at least about 3%, and more especially at least 3.5%, by weight or more at 10° C. below cloud point. Such a fuel is particularly difficult to treat if, in addition to a high waxy content, it is also characterized by a relatively low final boiling point, e.g., at most 370° C. and sometimes at most 360° C., or a narrow boiling range, e.g., one for which when distilled under ASTM D-86 conditions the 90%–20% temperature difference is in the range of from 700 to 100° C., for example at most 85° C. Earlier fuels of this type primarily originated from high waxy crude oils found in the Far East and Australia, but more recently, as a result of the requirement to reduce the sulphur and polynuclear hydrocarbon contents of fuels used in Europe and elsewhere, changes to refinery practices have taken place which have resulted in such fuels being produced worldwide.

In EP-A-239320 it is disclosed that the low temperature properties of a narrow-boiling, high wax content, fuel, having a narrow n-alkane distribution, may be improved by adding to the fuel an n-alkane mixture to effect a substantial increase in its content of $C_{24}$ and higher n-alkanes.

The alkanes are added in the form of a wax, or a gas oil, and enhance the response of the fuel to ethylene-vinyl acetate copolymer cold flow improvers. The addition of several (e.g., 5 to 7) per cent by weight of a high boiling fraction to a fuel comprising heavy and medium gas oils and kerosene to improve its response is a common refinery practice.

The present invention is concerned to provide an oil, especially a fuel oil, additive effective to improve the low temperature flow properties of an oil, especially one having a wax content of at least 3.0% at 10° C. below cloud point (wax appearance temperature) and/or a 90%–20% (as measured by ASTM D-86) boiling range of at most 100° C. The invention is based on the observation that a composition comprising a saturated hydrocarbon mixture having a substantial content of $C_{15}$ molecules and higher, a nucleator other than an ethylene-vinyl acetate copolymer, and a wax growth arrestor is an effective cold flow improver even at a low treat rate, for example, below 1 % by weight of active ingredients based on the weight of the fuel.

In a first aspect, the present invention provides an additive composition comprising (a) a mixture of saturated hydrocarbons, at least some of which have a number of carbon atoms within the range of from 15 to 60, (b) a nucleating agent, other than an ethylenevinyl acetate copolymer and other than a mixture as defined in (a), and (c) a wax growth arrestor, the weight ratio of (a):(b) being at least 0.85:1.

Advantageously the (a):(b) weight ratio is at least 0.9:1 and is preferably at least 1:1.

The composition may contain two or more nucleating agents (b); advantageously it contains two or more arrestors (c) and preferably, it contains two or more of both components (b) and (c). The composition may also contain two or more mixtures of hydrocarbons (a), which is advantageous if the mixtures differ in their carbon number contents. It is to be understood that the composition may contain an ethylene-vinyl acetate copolymer nucleating agent, in addition to the required component (b).

In a second aspect, the invention provides an additive composition comprising:

(a) at least two different mixtures of saturated hydrocarbons, in each of which mixtures there are at least some hydrocarbons having a number of carbon atoms within the range of 15 to 60, (b) optionally, a nucleating agent, other than a mixture as defined in (a), and (c) a wax growth arrestor.

The composition of the second aspect may contain two or more nucleating agents (b), and advantageously contains two or more arrestors (c).

When (b) is present, the (a):(b) weight ratio is advantageously at least 0.85:1, preferably at least 0.9:1 and more preferably at least 1:1.

Advantageously, component (a) the saturated hydrocarbon mixture comprises or the different mixtures comprise normal (linear) alkanes. Advantageously, the mixture has or mixtures have a boiling range from about 230 to 510° C. Advantageously, the mixture(s) contain(s) a spread of at least 16 carbon atoms from the lowest to the highest carbon number. Preferably, the mixture contains a substantial proportion of $C_{24}$ to $C_{32}$, more preferably a substantial proportion of $C_{24}$ to $C_{28}$, hydrocarbons, by weight. Advantageously, the number average molecular weight is in the range of 350 to 450. Advantageously, the mixture is a wax.

Waxes have conventionally been defined by reference to their physical characteristics, in view of the large and varied number of hydrocarbon components which they contain, and the difficulties in separating such closely related, and often homologous, hydrocarbon molecules. "Industrial Waxes", H. Bennett, 1975, describes the different types of petroleum wax and indicates that the characteristics of melting point and refractive index have proved useful in classifying the variety of waxes available from different sources. Waxes are also typically described in terms of their n-alkane content.

The wax may be an n-alkane wax or non n-alkane wax. The term "n-alkane wax" is used in this specification to mean a wax which comprises 40% or more n-alkanes by weight, based on the total weight of that wax.

Similarly, the term, "non n-alkane wax" is used in this specification to mean a wax which comprises less than 40% n-alkanes by weight, based on the total weight of that wax. Preferably, an n-alkane wax contains at least 55%, more preferably at least 60%, n-alkanes by weight. Preferably, a non n-alkane wax contains less than 35%, more preferably less than 30%, for example less than 20% or 15%, n-alkanes by weight.

When component (a) is a mixture of mixtures, especially two or more mixtures of normal and non-normal alkanes, this may be apparent from chromatographic characterization, which would show a bi- or multi-modal distribution of carbon numbers. In general, an n-alkane wax has a maximum in the carbon number distribution at a lower carbon number than does a non n-alkane wax.

More preferably, the n-alkane wax is a slack wax, for example, a slack wax obtained from dewaxing of heavy gas oils having viscosities equivalent to the lubricant viscosity ranges of 90 neutral to 400 neutral, for example: slackwax 90 neutral, slackwax 130 neutral, slackwax 150 neutral and slackwax 400 neutral. Such waxes normally comprise a range of hydrocarbon components containing between 15 and 60 carbon atoms, with the n-alkane distribution typically being n-$C_{15}$ to n-$C_{50}$, for example, n-$C_{15}$ to n-$C_{45}$.

Further examples of n-alkane waxes suitable for use in this invention include the various grades of "Shell wax", particularly Shellwax 130/135 and 125/130.

The non n-alkane wax may be a slackwax derived from a heavier viscosity stream (for example, slackwax 600 neutral) or a petrolatum or foots oil material.

The non n-alkane wax is preferably one having a melting point of 42 to 59° C. and a refractive index of 1.445 to 1.458. (Refractive index as used in this specification is measured according to ASTM D1747-94, at a temperature of 70° C.)

The melting point of a non n-alkane wax useful in the present invention is advantageously in the range of 44° C. to 55° C., preferably 45° C. to 53° C., and more preferably 47° C. to 53° C. Melting point as used in this specification is measured according to ASTM D938.

The refractive index of a wax useful in the present invention is preferably in the range of 1.445 to 1.455, more preferably in the range of 1.447 to 1.454, and most preferably in the range of 1.445 to 1.453, particularly in the range of 1.451 to 1.453.

Particularly suitable non n-alkane waxes have the following combinations of melting point and refractive index, measured according to the above-defined tests:

(i) advantageously a melting point in the range of 42° C. to 59° C. and a refractive index in the range of 1.445 to 1.455;

(ii) preferably a melting point in the range of 44° C. to 55° C. and a refractive index in the range of 1.447 to 1.454;

(iii) more preferably a melting point in the range of 45° C. to 53° C. and a refractive index in the range of 1.445 to 1.453; and (iv) most preferably a melting point in the range of 47° C. to 53° C. and a refractive index in the range of 1.451 to 1.453.

Surprisingly, it has been found that mixtures of different petroleum waxes have properties particularly useful for improving the low temperature flow properties of oils, and especially fuel oils, e.g., middle distillate fuel oils. Whilst not wishing to be bound by any particular theory, it is postulated that wax mixtures possess a combination of components which interact very favourably with precipitating n-alkanes present within the oil and with any further low temperature flow improver also present in the oil, such that the detrimental effects of precipitation of the wax inherent in the oil are reduced or even prevented.

Mixtures of two or more such waxes may show better performance in low temperature flow improver applications than a single wax.

Preferred wax mixtures are those in which at least one wax is an n-alkane wax and at least one wax is a non n-alkane wax.

Additives comprising one or more n-alkane slack waxes with one or more of the above forms of wax (i) to (iv) are particularly advantageous as flow improver compositions.

In a mixture of waxes, more than one of each type of wax may be used with advantage.

The different waxes used according to this invention are typically obtained by appropriate separation and fractionation of different wax-containing distillate fractions, and are available from wax suppliers.

As nucleating agent, component (b) of the additive composition, there may be mentioned, more especially a polyoxyalkylene ester, ether, ester/ether, amide/ester, or a mixture of two or more thereof, especially those containing at least one, preferably at least two, $C_{10}$ to $C_{39}$, advantageously linear, saturated aliphatic groups, and a polyoxyalkylene glycol of molecular weight 100 to 5000, preferably 200 to 5000, the alkylene groups advantageously containing from 1 to 4 carbon atoms. Preferred glycols are polyethylene and polypropylene glycols. Mixtures of glycols of different molecular weights may be used, and are in some cases preferred. Particularly preferred are mixtures of glycols of molecular weight of about 200, 400, and 600. Esters are preferred, the esters of fatty acids containing from 10 to 30, more especially from 18 to 22, carbon atoms being particularly preferred, for example, behenic and stearic acids.

As another group of materials suitable as component (b) there may be mentioned a $C_8$ to $C_{32}$ hydrocarbyl ester of a tertiary-amine-substituted aliphatic carboxylic acid. More especially there may be mentioned compounds of the formula $$(R^1R^2N)_e—A—(NR^1R^3)_f$$

or $$BNR^1_2$$

wherein

A represents an (e+f) valent and B represents a monovalent hydrocarbon radical optionally interrupted by at least one heteroatom selected from oxygen and nitrogen, each $R^1$ independently represents $$—CHR^4(CHR^5)_pCOOR^6$$

$R^2$ and $R^3$ each independently represent $R^1$, H, or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, e and f each represent an integer up to 12 or zero provided that the total number of $R^1$ groups is at least 2, and p represents zero or an integer within the range of from 1 to 4. Further details of such compounds are set out in International Patent Application No. W098/03614 the disclosure of which is incorporated by reference herein.

Advantageously, A or B represents a radical containing from 1 to 200, preferably from 2 to 65, carbon atoms. A or B may represent a saturated aliphatic radical or a radical of the formula $$—[CH(CH_3)CH_2O]_a—[CH_2CH_2O]_b—[CH_2CH(CH_3)O]_c—CH_2CH(CH_3)—,$$

where a+c is within the range of 2 to 4 and b is within the range of 5 to 100.

A preferred member of this group is a $C_{18}$ to $C_{22}$ mixed alkyl tetraester of hexane diamine tetrapropionic acid.

As wax growth arrestor, component (c) of the additive composition, there may be mentioned an ionic or non-ionic polar nitrogen compound.

Such compounds, which are oil-soluble, advantageously include at least one, preferably at least two, substituents of the formula $NR^7$, where $R^7$ represents a hydrocarbyl group containing 8 to 40 carbon atoms, which substituent or one or more of which substituents may be in the form of a cationic derivative. As examples there may be mentioned the following groups of compounds:

(i) An amine salt and/or amide obtainable by the reaction of at least one molar proportion of a hydrocarbyl substituted amine with a molar proportion of a hydrocarbyl acid having from 1 to 4 carboxylic acid groups or an anhydride thereof, the substituent(s) having the formula $>NR^7$ advantageously being of the formula $—NR^7R^8$ where $R^7$ is as defined above and $R^8$ represents hydrogen or $R^7$, provided that $R^7$ and $R^8$ may be the same or different, said substituents constituting part of the amine salt and/or amide groups of the compound.

Advantageously, ester/amides containing 30 to 300, preferably 50 to 150, total carbon atoms are used, these nitrogen compounds being described in U.S. Pat. No. 4,211,534. Preferred amines are $C_{12}$ to $C_{40}$ primary, secondary, tertiary or quaternary amines or mixtures thereof, although shorter chain amines may be used provided the resulting nitrogen compound is oil soluble.

The nitrogen compound advantageously contains at least one linear $C_8$ to $C_{40}$, preferably $C_{14}$ to $C_{24}$, alkyl segment.

Secondary amines are preferred, tertiary and quaternary amines only forming amine salts. As examples of amines there may be mentioned tetradecylamine, cocoamine, and hydrogenated tallow amine. Examples of secondary amines include dioctadecylamine and methylbehenylamine. Amine mixtures are also suitable, for example, those derived from natural materials. A preferred amine is a secondary hydrogenated tallow amine of the formula $HNR^1R^2$ wherein $R^1$ and $R^2$ are alkyl groups derived from hydrogenated tallow fat (normally composed of approximately 4% $C_{14}$, 31% $C_{16}$, 59% $C_{18}$ alkyl groups).

Examples of suitable carboxylic acids and their anhydrides for preparing the is nitrogen compounds include cyclohexane-1,2-dicarboxylic acid, cyclohexene-1,2-dicarboxylic acid, cyclopentane-1,2dicarboxylic acid and naphthalene dicarboxylic acid, and 1,4-dicarboxylic acids including dialkyl spirobislactone. Generally, these acids have from 5 to 13 carbon atoms in the cyclic moiety. Preferred acids are the benzene dicarboxylic acids, phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of hydrogenated tallow amine. Another preferred compound is the diamide formed by dehydrating this amide-amine salt.

Other examples are long chain alkyl or alkylene substituted dicarboxylic acid derivatives, for example the amine salts of monoamines of substituted succinic acids, examples of which are known in the art and described, for example, in U.S. Pat. No. 4 147 520. Suitable amines may be those described above.

Other examples are condensates, for example, those described in EP-A-327,423.

(ii) A compound comprising a ring system, the compound carrying at least two, but preferably only two, substituents of the general formula (I) below on the ring system $$—A—NR^9R^{10} \quad (I)$$

where A is an aliphatic hydrocarbylene group optionally interrupted by one or more hetero atoms and that is straight chain or branched, and $R^9$ and $R^{10}$ are the same or different and each is independently a hydrocarbyl group containing 9 to 40, advantageously from 16 to 40, preferably from 16 to 24, carbon atoms, optionally interrupted by one or more hetero atoms, the substituents being the same or different and the compound optionally being in the form of a salt thereof. Advantageously, $R^9$ and $R^{10}$ are linear, and advantageously R9 and $R^{10}$ are alkyl, alkenyl, or an alkyl-terminated mono- or polyoxyalkylene group.

Advantageously, A contains from 1 to 20 carbon atoms and is preferably a methylene or polymethylene group.

The ring system may comprise homocyclic, heterocyclic, or fused polycyclic assemblies, or a system where two or more such cyclic assemblies are joined to one another, and in which the cyclic assemblies may be the same or different. Where there are two or more such cyclic assemblies, the substituents of the formula $—A^1—NR^9R^{10}$ may be on the same or different assemblies, but are preferably on the same assembly. Preferably, the or each cyclic assembly is aromatic, more preferably a benzene ring. Most preferably, the cyclic ring system is a single benzene ring, when it is preferred that the substituents are in the ortho or meta positions, the ring being optionally further substituted.

The ring atoms in the cyclic assembly or assemblies are preferably carbon atoms but may for example include one or more ring N, S or O atoms.

Examples of polycyclic assemblies include (a) condensed benzene structures, e.g., naphthalene, anthracene, phenanthrene, and pyrene;

(b) condensed ring structures containing rings other than benzene, e.g., azulene, indene, hydroindene, fluorene, and diphenylene oxides:

(c) rings joined "end-on", e.g., diphenyl;

(d) heterocyclic compounds e.g., quinoline, indole, 2,3-dihydroindole, benzofuran, coumarin, isocoumarin, benzothiophen, carbazole and thiodiphenylamine;

(e) non-aromatic or partially saturated ring systems e.g., decalin (decahydronaphthalene), α-pinene, cardinene, and bornylene; and (f) bridged ring structures e.g., norbomene, bicycloheptane (i.e. norbornane), bicyclooctane, and bicyclooctene.

(iii) A condensate of a long chain primary or secondary amine with a carboxylic acid-containing polymer.

Specific examples include the polymers described in GB-A-2,121,807, FR-A-2,592,387 and DE-A-3,941,561; the esters of telomer acids and alkanoloamines described in U.S. Pat. No. 4,639,256; and the reaction product of an amine containing a branched carboxylic acid ester, an epoxide and a monocarboxylic acid polyester described in U.S. Pat. No. 4,631,071.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and, preferably, oxygen. Advantageously, the hydrocarbyl group contains at most 30, preferably at most 15, more preferably at most 10 and most preferably at most 8, carbon atoms.

Another group of materials suitable for use as component (c), the wax growth arrestor, comprises acrylate and methacrylate, hereinafter collectively referred to as (meth) acrylate, homo- and co-polymers. Examples of such polymers are copolymers of (meth)acrylic esters of at least two, linear or branched, alkanols containing various numbers of carbon atoms, e.g., from 6 to 40, especially copolymers of methacrylic esters of $C_{18}$ to $C_{22}$ linear alkanols, optionally together with an olefinic monomer, e.g., ethylene, or a nitrogen-containing monomer, e.g., N-vinyl pyridine or a dialkylaminoalkyl (meth)acrylate. The weight average molecular weight, as measured by GPC, of the polymer is advantageously within the range of from 50,000 to 500,000. A presently preferred polymer of this type is a copolymer of methacrylic acid and a methacrylic ester of $C_{14}/C_{15}$ saturated alcohols (1:9 molar ratio), the acid groups being neutralized with di(hydrogenated tallow) amine, this material being referred to below as Additive F.

A further group of materials suitable for use as component (c) comprises ethylene-unsaturated, more especially vinyl, ester copolymers. Without wishing to be bound by theory it is believed that the lower molecular weight copolymers of this class having a relatively high ester content behave primarily as arrestors. Accordingly, there are advantageously used copolymers of such esters, e.g., the acetate, propionate, octanoate (especially the 2-ethylhexanoate), including terpolymers, especially terpolymers of ethylene, vinyl acetate, and a vinyl ester of a C2 to C10 alkanecarboxylic acid, especially 2-ethylhexanoic acid. The copolymer advantageously has a number average molecular weight, measured by GPC, of at most 20,000, and more especially from 1,200 to 6,000, preferably 3,000 to 5,000, and especially about 3,500, with a vinyl ester content of at least 7.5 molar per cent, preferably from 7.5 to 35 molar per cent.

In an especially advantageous embodiment of the invention, the additive composition comprises an alkane mixture, a polyoxyalkylene glycol ester, especially a polyoxyethylene glycol ester, or a second alkane mixture, as nucleator component, and a polar nitrogen compound and an ethylene-vinyl ester as arrestor components.

A further group of materials suitable for use as component (c) comprises comb polymers. Such polymers are discussed in "Comb-Like Polymers. Structure and Properties", N. A. Plate and V. P. Shibaev, J. Poly. Sci. Macromolecular Revs., 8, p 117 to 253 (1974).

Advantageously, the comb polymer is a homopolymer having, or a copolymer at least 25 and preferably at least 40, more preferably at least 50, molar per cent of is the units of which have, side chains containing at least 6, and preferably at least 10, atoms.

As examples of preferred comb polymers there may be mentioned those of the general formula

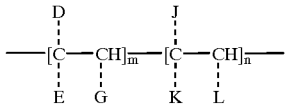

wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11}$=$C_{10}$ hydrocarbyl, $R^{12}$=$C_1$ hydrocarbyl or hydrocarbylene, and m and n represent mole ratios, m being within the range of from 1.0 to 0.4, n being in the range of from 0 to 0.6. $R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g., an a-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or taconite polymers and copolymers such for example as those described in EP-A-153176, 153177 and 225688, and WO 9 1/1164 07.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

The additive composition may contain other additives for improving low temperature and/or-other properties, many of which are in use in the art or known from the literature.

For example, as indicated above, the composition may also comprise an ethylene-vinyl ester copolymer nucleator, in addition to the nucleator essential to the invention; such nucleator copolymers advantageously have a number average molecular weight higher than that of the ethylene-vinyl ester copolymer arrestor, for example, in the range of from 3,000 to 20,000, advantageously from 1,200 to 10,000, more especially from 4,500 to 8,000, and especially about 5,000, and a lower ester content, e.g., advantageously less than 7.5, preferably from 0.3 to 7.5, and preferably from 3.5 to 7.0, molar per cent.

The additive composition of the invention may also comprise a copolymer of ethylene and at least one α-olefin, having a number average molecular weight of at least 30,000. Preferably the α-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g, up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene α-olefin copolymer is, as indicated above, at least 30,000, as measured by GPC relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-a-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

The invention also provides an oil containing the additive composition, and an additive concentrate comprising the additive composition in admixture with an oil or a solvent miscible with the oil. The invention further provides the use of the additive composition to improve the low temperature properties of an oil. The oil may be a crude oil, i.e. oil obtained directly from drilling and before refining, the compositions of this invention being suitable for use as flow improvers therein.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils or oxidized mineral oil. Such an oil may contain additives depending on its intended use; examples are viscosity index improvers such as ethylene-propylene copolymers, succinic acid based dispersants, metal containing dispersant additives and zinc dialkyldithiophosphate antiwear additives. The compositions of this invention may be suitable for use in lubricating oils as flow improvers, pour point depressants or dewaxing aids.

The oil may be a fuel oil, especially a middle distillate fuel oil. Such distillate fuel oils generally boil within the range of from 110° C. to 500° C., e.g. 150° to 400° C. The fuel oil may comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils.

The heating oil may be a straight atmospheric distillate, or it may contain minor amounts, e.g. up to 35 wt %, of vacuum gas oil or cracked gas oils or of both.

As indicated above, the additive composition of the invention is especially useful in connection with fuel oils of high wax content and a narrow boiling range, but is also suitable for use in other fuel oils. The invention is also applicable to vegetable-based fuel oils, for example rape seed oil, used alone or in admixture with a petroleum distillate oil.

The additive should preferably be soluble in the oil to the extent of at least 1000 ppm by weight per weight of oil at ambient temperature. However, at least some of the additive may come out of solution near the cloud point of the oil and function to modify the wax crystals that form.

In addition, the additive composition and the fuel oil composition may contain additives for other purposes, e.g., for reducing particulate emission or inhibiting color and sediment formation during storage.

The fuel oil composition of the invention advantageously contains the additive of the invention, i.e., components (a), (b), and (c), above, in a total proportion of 0.0005% to 2%, advantageously 0.001 to 0.3%, and preferably 0.01 to 0.26% by weight, based on the weight of fuel.

The following Examples, in which parts and percentages are by weight, illustrate the invention:

The following fuel was used in the Examples Heavy Gas Oil: Medium Gas Oil -Kerosene 48 32:20.

| | |
|---|---|
| Cloud Point, 'IC | −5.5 |
| CFPP, 'IC | −5.5 |
| Pour Point | −5.5 |
| IBP, 'IC | 179 |
| FBP, 'IC | 350 |
| 90-20, 'IC | 82 |
| FBP-90, 'IC | 17 |
| WAT, 'IC | −9 |
| % Wax at 5'IC below Cloud Point | 2.4 |
| At 10'IC below | 3.9 |

CFPP is measured as described in "Journal of the Institute of Petroleum", 52 (1966),173.

In the Examples below, the following materials were used as additives.

| Additive | Material |
|---|---|
| A | Dibehenate ester of a polyethylene glycol mixture (Mn of 200, 400, 600) |
| B | $C_{18}$ to $C_{22}$ alkyl tetraester of hexanediamine tetrapropionic acid |
| C | Shell Wax 130/135 |
| D | Foots Oil |
| E | Half amide half amine salt adduct of phthalic anhydride and di(hydrogenated tallow) amine |
| F | poly (methacrylate) |
| G | ethylene-vinyl acetate copolymer 36.5 wt% acetate, Mn by GPC of 3500 |
| H | ethylene-vinyl 2-ethylhexanoate copolymer, 85 mole % ethylhexanoate, 4.8 non-terminal methyl group per 100 methylene units. |

Additives A to D are nucleators, additives E to H are arrestors. The Shell Wax has a melting point of about 60° C. and an RI of 1.433; foots oil has a melting point in the range of 34 to 40° C. and an RI in the range of 1.438 to 1.451 at 70° C.

In addition to the CFPP test, identified above, the pour point of the treated fuel was measured by ASTM D97 and the fuel was also subjected to the ASPP-GT test, which is carried out as described in EP-A403 097 with the temperature falling at 20° C. per hour. In a preferred embodiment of the invention, depression of CFPP and ASPP values of greater than 15° C. and 10° C. are obtained.

Comparative Examples A to H

In these Examples, a sample of fuel containing each of additives A to H alone was tested using the additive, at the treat rate of active ingredient shown.

| Example | Additive | Treat Rate, ppm | Pour Point | CFPP | ASPP |
|---|---|---|---|---|---|
| | NONE | | −5.5 | −5.5 | −5 |
| A | A | 400 | −3 | −12 | −4 |
| B | B | 400 | −6 | −7 | −5 |
| C | C | 800 | −6 | −7 | −4 |
| D | D | 1200 | −6 | −9 | −4 |
| E | E | 400 | −24 | −6 | −5 |
| F | F | 400 | −18 | −5 | −4 |
| G | G | 400 | <−42 | −8 | −5 |
| H | H | 400 | <−40 | −7 | −5 |

As can be seen, the nucleators alone give modest improvement in CFPP, with no pour point or ASPP depression, while the arrestors alone give modest CFPP improvement, no ASPP, but excellent pour point depression.

Comparative Examples J to M

In these Examples, combinations of two or three nucleators (Examples J and K) or two or more arrestors (Examples L and M) were tested, each individual nucleator and arrestor being used at the treat rate indicated in Examples A to H above, these individual treat rates being used in Comparative Examples J to W and in Examples 1 to 20.

| Example | Additives | Pour Point | CFPP | ASPP |
|---|---|---|---|---|
| J | A,C | −3 | −11 | −4 |
| K | A,B,D | −3 | −14 | −6 |
| L | E,G | <−43 | −11 | −6 |
| M | E,F,G | −27 | −13 | −6 |

These examples show little improvement in results over those with the single additives despite the higher total treat rates.

Comparative Examples N to U

In these Examples, combinations of a single nucleator with one or more arrestors were tested.

| Example | Additives | Pour Point | CFPP | ASPP |
|---|---|---|---|---|
| N | A,G | −33 | −6 | −5 |
| O | A,E,F,H | −27 | −17 | −10 |
| P | B,G | −30 | −8 | −5 |
| Q | B,E,F,H | −27 | −11 | −7 |
| R | C,G | <−47 | −9 | −5 |
| S | C,E,F,H | −27 | −16 | −10 |
| T | D,G | <−45 | −8 | −6 |
| U | D,E,F,H | −27 | −17 | −8 |

Although a single nucleator with a combination of arrestors gives better ASPP results than does a single nucleator/arrestor combination, the preferred depression (greater than 10° C.) is still not achieved.

EXAMPLES 1 to 20

In these Examples, combinations of two nucleators, at least one being an alkane, and at least two arrestors, were tested.

| Example | Additives | Pour Point | CFPP | ASPP |
|---|---|---|---|---|
| 1 | A,C,E,G | −27 | −18 | −14 |
| 2 | A,C,E,H | −30 | −20 | −10 |
| 3 | A,C,E,F,G | −24 | −18 | −15 |
| 4 | A,C,E,F,H | −27 | −22 | −16 |
| 5 | A,C,E,G,H | <−38 | −23 | −17 |
| 6 | A,D,E,G | −27 | −18 | −10 |
| 7 | A,D,E,F,G | −24 | −19 | −16 |
| 8 | A,D,E,F,H | −24 | −19 | −16 |
| 9 | A,D,E,G,H | <−37 | −21 | −15 |
| 10 | C,D,E,G | −27 | −17 | −13 |
| 11 | C,D,E,H | −27 | −20 | −11 |
| 12 | C,D,E,F,G | −24 | −19 | −16 |
| 13 | C,D,E,F,H | −27 | −20 | −16 |
| 14 | C,D,E,G,H | <−39 | −20 | −13 |
| 15 | B,C,D,E,G,H | <−34 | −23 | −14 |
| 16 | A,C,D,E,G | −27 | −23 | −14 |
| 17 | A,C,D,E,H | −27 | −22 | −16 |
| 18 | A,C,D,E,F,G | −24 | −21 | −14 |
| 19 | A,C,D,E,F,H | −27 | −20 | −15 |
| 20 | A,C,D,E,G,H | <−36 | −24 | −15 |

As will be seen, the compositions comprising an alkane mixture, a nucleator, being a polyoxyalkylene glycol ester or a second alkane mixture, and two or more arrestors, especially a polar nitrogen compound in combination with an ethylene-vinyl ester copolymer, provide effective depression of all three of pour point, CFPP, and ASPP.

What is claimed is:

1. An additive composition comprising:

(a) a mixture of saturated hydrocarbons, at least some of which have a number of carbon atoms within the range of from 15 to 60, (b) a polyoxyalkylene glycol ester of a fatty acid having 10–30 carbon atoms, the polyoxyalkylene glycol having a molecular weight 100 to 5,000 nucleating agent, and (c) a wax growth arrestor, the weight ratio of (a):(b) being at least 0.85:1.

2. A composition as claimed in claim 1, wherein component (a) contains a range of at least 16 carbon atoms from the lowest to the highest carbon number.

3. A composition as claimed in claim 1, wherein component (a) is a wax or a mixture of waxes.

4. A composition as claimed in claim 3, wherein component (a) comprises a mixture of waxes, and wherein one wax contains at least 40% by weight n-alkanes and another wax contains at most 40% by weight n-alkanes.

5. A composition as claimed in claim 1, wherein component (b) is a dibehenate ester, or a mixed behenate and stearate ester, of a mixture of three polyethylene glycols of molecular weights of about 200, 400, and 600.

6. A composition as claimed in claim 1, wherein component (c) is a polar nitrogen compound.

7. A composition as claimed in claim 6, wherein component (c) is an amine salt or an amide obtainable by reaction of at least one molar proportion of a hydrocarbyl-substituted amine with a molar proportion of a hydrocarbyl acid having up to 4 carboxyl groups, or an anhydride thereof.

8. A composition as claimed in claim 1, wherein component (c) is a (meth)acrylate homo- or co-polymer.

9. A composition as claimed in claim 1, wherein component (c) is an ethylene-unsaturated ester copolymer.

10. A composition as claimed in claim 9 wherein the copolymer is an ethylene-vinyl acetate copolymer.

11. A composition as claimed in claim 1, wherein component (c) is a comb polymer.

12. A composition as claimed in claim 11, wherein the comb polymer is a copolymer of vinyl acetate and a fumarate ester.

13. A composition as claimed in claim 1 further comprising an ethylene-vinyl ester copolymer nucleator.

14. A fuel or lubricating oil composition comprising an additive composition as claimed in claim 1.

15. An additive concentrate comprising the composition defined in claim 1 in an oil or a solvent miscible with oil.

16. An additive composition comprising:

(a) at least two different mixtures of saturated hydrocarbons, in each of which mixtures there are at least some hydrocarbons having a number of carbon atoms within the range of 15 to 60, (b) a polyoxyalkylene glycol ester of a fatty acid having 10–30 carbon atoms, the polyoxyalkylene glycol having a molecular weight 100 to 5,000 nucleating agent, other than a mixture as defined in (a), and (c) a wax growth arrestor.

17. A composition as claimed in claim 16, wherein component (a) contains a range of at least 16 carbon atoms from the lowest to the highest carbon number.

18. A composition as claimed in claim 16, wherein component (a) is a wax or a mixture of waxes.

19. A composition as claimed in claim 18, wherein component (a) comprises a mixture of waxes, and wherein one wax contains at least 40% by weight n-alkanes and another wax contains at most 40% by weight n-alkanes.

20. A composition as claimed in claim 16, wherein component (b) is a dibehenate ester, or a mixed behenate and stearate ester, of a mixture of three polyethylene glycols of molecular weights of about 200, 400, and 600.

21. A composition as claimed in claim 16 wherein component (c) is a polar nitrogen compound.

22. A composition as claimed in claim 21, wherein component (c) is an amine salt or an amide obtainable by reaction of at least one molar proportion of a hydrocarbyl-substituted amine with a molar proportion of a hydrocarbyl acid having up to 4 carboxyl groups, or an anhydride thereof.

23. A composition as claimed in claim 16, wherein component (c) is a (meth)acrylate homo- or co-polymer.

24. A composition as claimed in claim 16, wherein component (c) is an ethylene-unsaturated ester copolymer.

25. A composition as claimed in claim 24 wherein the copolymer is an ethylene-vinyl acetate copolymer.

26. A composition as claimed in claim 16, wherein component (c) is a comb polymer.

27. A composition as claimed in claim 26, wherein the comb polymer is a copolymer of vinyl acetate and a fumarate ester.

28. A composition as claimed in claim 16 further comprising an ethylene-vinyl ester copolymer nucleator.

29. A fuel or lubricating oil composition comprising an additive composition as claimed in claim 16.

30. An additive concentrate comprising the composition defined in claim 16 in an oil or a solvent miscible with oil.

31. A composition according to claim 1 or claim 2 wherein the nucleating agent is an ester of a polyoxyalkylene glycol of molecular weight 100 to 5,000.

32. A composition according to claim 1 or claim 2 wherein the nucleating agent is an ether of a polyoxyalkylene glycol of molecular weight 100 to 5,000.

33. A composition according to claim 31 where the ester is that of a fatty acid having 10 to 30 carbon atoms.

* * * * *